United States Patent [19]

Bond

[11] 4,151,534

[45] Apr. 24, 1979

[54] ANTENNA TELESCOPING TOWER

[76] Inventor: Orville R. Bond, P.O. Box 3412, Enid, Okla. 73701

[21] Appl. No.: 833,219

[22] Filed: Sep. 14, 1977

[51] Int. Cl.[2] ..... H01Q 1/10

[52] U.S. Cl. ..... 343/883; 343/901

[58] Field of Search ..... 343/883, 901, 900, 882; 52/110, 118, 121, 117

[56] References Cited

U.S. PATENT DOCUMENTS

| | | | |
|---|---|---|---|
| 2,795,303 | 6/1957 | Muehlhause et al. | 52/121 |
| 2,822,067 | 2/1958 | Price | 52/121 |
| 3,500,429 | 3/1970 | Majkrzak et al. | 343/883 |

*Primary Examiner*—Alfred E. Smith
*Assistant Examiner*—David K. Moore
*Attorney, Agent, or Firm*—Robert K. Rhea

[57] ABSTRACT

A free standing mast for antennas comprising a plurality of telescoping tubes. Guide members, secured to the tubes, prevent rotation of an inner tube relative to an outer tube. Cables and pulleys, secured to the tubes, extend and retract the tubes.

6 Claims, 10 Drawing Figures

ANTENNA TELESCOPING TOWER

BACKGROUND OF THE INVENTION

1. Field of the Invention

The present invention relates to telescoping towers or masts for supporting antennas or lighting fixtures and more particularly to a free standing telescoping mast.

In many areas remote from the location of broadcast stations it is necessary to elevate an antenna a substantial height above the surface of the earth in order to receive the broadcast signals due, at least in part, to the curvature of the earth. It is also desirable that the mast be capable of being lowered to a position near the ground for access to the antenna for its repair or replacement. This invention provides such a mast.

2. Description of the Prior Art

Towers or masts presently in use, some of which are telescoping, are usually supported against wind or storm damage by a plurality of guy wires. These guy wires are a source of trouble in that they frequently must be tightened and/or replaced if they become loose or damaged as a result of expansion and contraction or by being run into by an animal or machinery.

The present invention provides a free standing mast comprising at least two telescoping tubular members of different cross sectional configuration and including a winch for extending and retracting the telescoping member from a point near the ground. Guide members are connected with the tubes to prevent relative rotation between the tubes.

SUMMARY OF THE INVENTION

In one embodiment an elongated base tube, circular in transverse section, is vertically supported by its depending end being embedded in the surface of the earth. An intermediate tube, square in transverse section, is telescopically received by the base tube. A base cap plate on the upper end of the base prevents rotation of the intermediate tube relative to the base tube. A winch, connected with the base tube, has its cable entrained over a pulley mounted on the base cap plate and connected with the depending end of the intermediate tube. An upper tube, circular in transverse section, is telescopically received by the intermediate tube. A plurality of guides, secured to the respective tubes, prevents angular rotation of the tubes with respect to each other. A flexible strand, connected at one end with the depending end portion of the base tube, is entrained over a top pulley mounted on the upper end of the intermediate tube and connected with the depending end of the upper tube. Operation of the winch raises and lowers the intermediate tube while simultaneously the flexible strand raises and lowers the upper tube with respect to the intermediate tube.

In another embodiment, the depending end portion of the base tube is pivotally connected with a standard vertically supported by the earth. A second winch, mounted on the standard, has its line connected with the base tube above the standard for raising and lowering the telescoping mast in a lateral tilting action toward and away from the surface of the earth.

The principal object of this invention is to provide a television antenna supporting telescoping tower which may be raised and lowered toward and away from the surface of the earth by the owner thereof.

DESCRIPTION OF THE PREFERRED EMBODIMENTS

Figure 1:
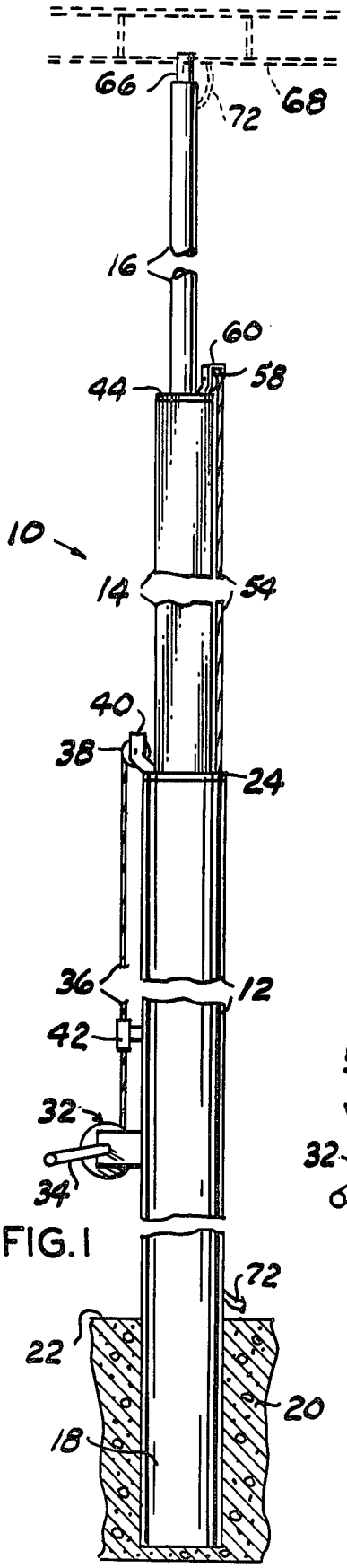
FIG. 1 is a fragmentary elevational view, partially in section, of the tower in telescopically extended position.
Figure 2:
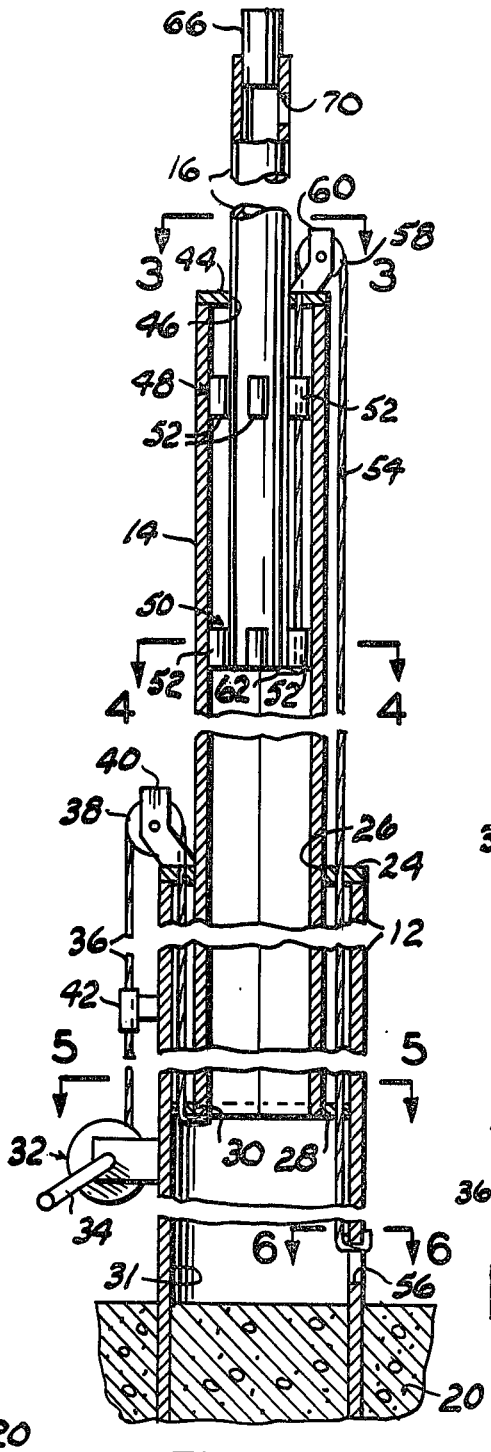
FIG. 2 is a vertical cross sectional view, to a larger scale, partially in elevation, illustrating the intermediate tube rotated 45° about its vertical axis with respect to its position illustrated by FIG. 1.

Like characters of reference designate like parts in those figures of the drawings in which they occur.

In the drawings:

Referring more particularly to FIGS. 1 through 6, the reference numeral 10 indicates the tower, as a whole, which is elongated step diameter pole-like when in telescopically extended position. The tower 10 comprises a base section or tube 12, an intermediate tube 14 and a top tube 16. The base tube 12 comprises an elongated tube of selected length, for example 20 feet (6.096 meters), circular in transverse section, having its depending end portion 18 embedded in a section of concrete 20, disposed below the surface of the earth, indicated by the line 22. The intermediate tube 14 is similarly elongated, preferably square in transverse section, having a length substantially equal to the length of the base section 12 and is centrally disposed therein.

A base cap plate 24, diametrically equal with respect to the diameter of the base 12, overlies the upper end of the base and is provided with a central square aperture 26 dimensioned for vertically slidably receiving the intermediate tube 14 to prevent angular rotation thereof with respect to the base 12. A bottom plate 28, having a central square aperture 30, snugly surrounding the wall of the intermediate tube adjacent its depending end, is transversely secured thereto. The bottom plate 28 is provided with a circular periphery dimensioned to be slidably received by the inner wall surface 31 of the base tube to act as a stabilizer in maintaining the longitudinal axis of the intermediate tube concentric with the base tube during telescoping movement of the intermediate tube, as presently explained.

A winch 32, having an operating handle 34 and suitable locking means, not shown, is rigidly secured to the periphery of the base tube 12 at a selected location spaced above the surface of the earth. The winch cable 36 is entrained over a base pulley 38 journalled by a base bracket 40 mounted on the base cap 24 adjacent one of the flat surfaces formed by the square configuration of the intermediate tube 14 and is entrained at its other end portion downwardly in the annulus between the base 12 and depending end portion of the intermediate tube 14 through suitable vertical aligned apertures formed in the base cap 24 and bottom plate 28 with the depending end portion of the cable secured to the depending end of the intermediate tube 14. A winch cable guide 42, secured to the outer surface of the base 12 between the winch 32 and pulley 38, maintains the winch line 36 in spaced relation with respect to the outer wall of the base.

The upper tube 16, preferably circular in transverse section, having a diameter freely received by the inner wall surface of the intermediate tube and a length substantially equal to the length of the intermediate tube is telescopically disposed within the intermediate tube. A square top plate 44, having dimensions substantially equal with respect to the transverse dimensions of the intermediate tube, is secured to the upper end thereof in overlying relation and is provided with a central aperture 46 sildably receiving the upper tube 16.

Two sets of stabilizing means 48 and 50 are secured to the depending end portion of the upper tube within the intermediate tube 14. Each set of stabilizers comprises four right circular cylindrical sections of rod 52 arranged in a horizontal array with their longitudinal axis vertical and in 90° spaced relation about the periphery of the upper tube so that a peripheral portion of each rod 52 is slidably received by the respective right annular inner corner surface formed by the inner wall surface of the intermediate tube. The stabilizer means 48 and 50 are preferably spaced-apart vertically a selected distance to maintain the upper tube concentric with the intermediate tube and prevent angular rotation of the upper tube with respect to the intermediate tube.

With the outer tube 16 telescoped a desired distance into the intermediate tube 14, an elongated flexible element 54 is connected at one end with the outer surface of the base 12 and passes through an aperture 56 formed in the wall of the base adjacent the surface of the earth. The flexible element 54 is entrained upwardly through suitable vertically aligned apertures formed in the base cap 24 and bottom plate 28 and the annulus between the base 12 and the intermediate tube 14 and over a top pulley 58 supported by a top bracket 60 secured to the top plate 44. The element 54 then extends downwardly through an aperture formed in the top plate 44 and through a vertical aperture formed in two of the vertical aligned stabilizer rod sections 52 where it is connected at its other end portion to the depending end of the upper tube 16. The upper stabilizer means 48 forms a stop limiting the telescopically extended position of the upper tube while the length of the flexible line 54 limits the telescopic retracting movement of the upper tube into the intermediate tube.

A stop pin 64 is horizontally secured to the inner surface 31 of the base tube at the upper limit of the aperture 56 which is contacted by the bottom plate 28 and stops telescopic retracting movement of the intermediate tube 14 into the base 12.

The upper end portion of the upper tube 16 is provided with a coaxial adapter 66 for connecting a television antenna 68 thereto. The upper end portion of the upper tube is provided with an aperture 70 in its wall below the adapter 66 for receiving the lead in wire or cable 72 from the antenna to pass downwardly through the bore of the telescoping mast 10 and outwardly through the base aperture 56.

Figure 7:
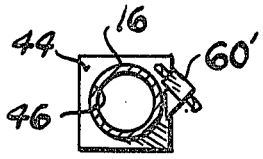
FIGS. 7 and 8 are horizontal sectional views, partially in elevation, respectively, illustrating alternative embodiments of FIGS. 3 and 5.
Figure 3:
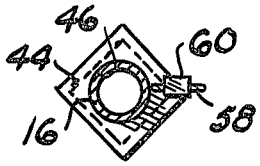
FIGS. 3, 4, 5 and 6 are horizontal sectional views, partially in elevation, taken substantially along the lines 3—3, 4—4, 5—5 and 6—6, respectively, of FIG. 2.
Figure 4:
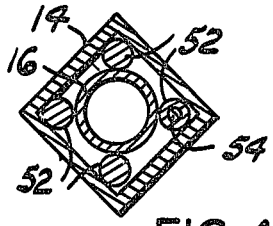
Figure 5:
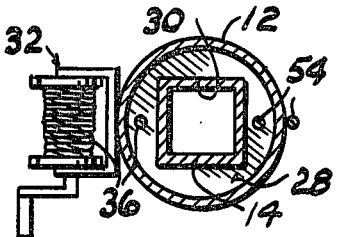
Figure 8:
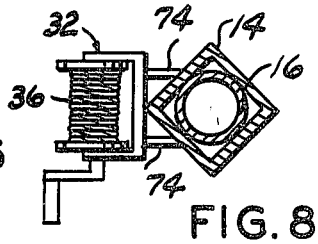
Figure 6:
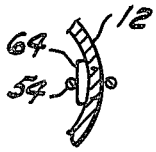

Referring also to FIGS. 7 and 8, it is sometimes desired to use a shorter tower than that provided by the tower 10 and in this event the intermediate tube 14 is utilized as a base tube and is similarly anchored in the concrete 20. The winch means 32 is mounted on one corner of the square tube 14 by suitable braces 74 with the winch cable 36 entrained over the top pulley 58 and similarly connected with the depending end of the upper tube 16 which is mounted in the tube 14, in the manner described hereinabove, the bracket 60 of the top pulley 58 being modified, as at 60', so that the winch cable similarly passes through the apertured stabilizer rods.

Production models of the towers assembled and installed as above described, including a 22 pound (7.55 kilogram) antenna having a projected vertical area of 4 sq. ft. (0.37 sq. meters) will withstand wind velocity of 71 mphr (61.66 knots/hr).

In the operation of the tower described by FIGS. 1 through 6, the tower is assembled and mounted in the concrete 20 as described hereinabove. The tower is telescopically extended, after installing the antenna 68, by winding up the winch cable 36 which progressively lifts the inner tube 14 upwardly to a telescopically extended position outwardly of the base 12. Similarly, the fixed end position of the flexible line 54, by upward movement of the intermediate tube 14, progressively lifts the upper tube 16 to a telescopically extended position relative to the intermediate tube. The winch means 32 is then locked in tower extended or elevated position. When the tower is to be retracted, the winch means 32 is unlocked and the winch cable 36 progressively payed out to allow the intermediate tube to telescope by gravity into the base 12 while simultaneously the upper tube 16 telescopes into the intermediate tube.

Figures 9, 10:
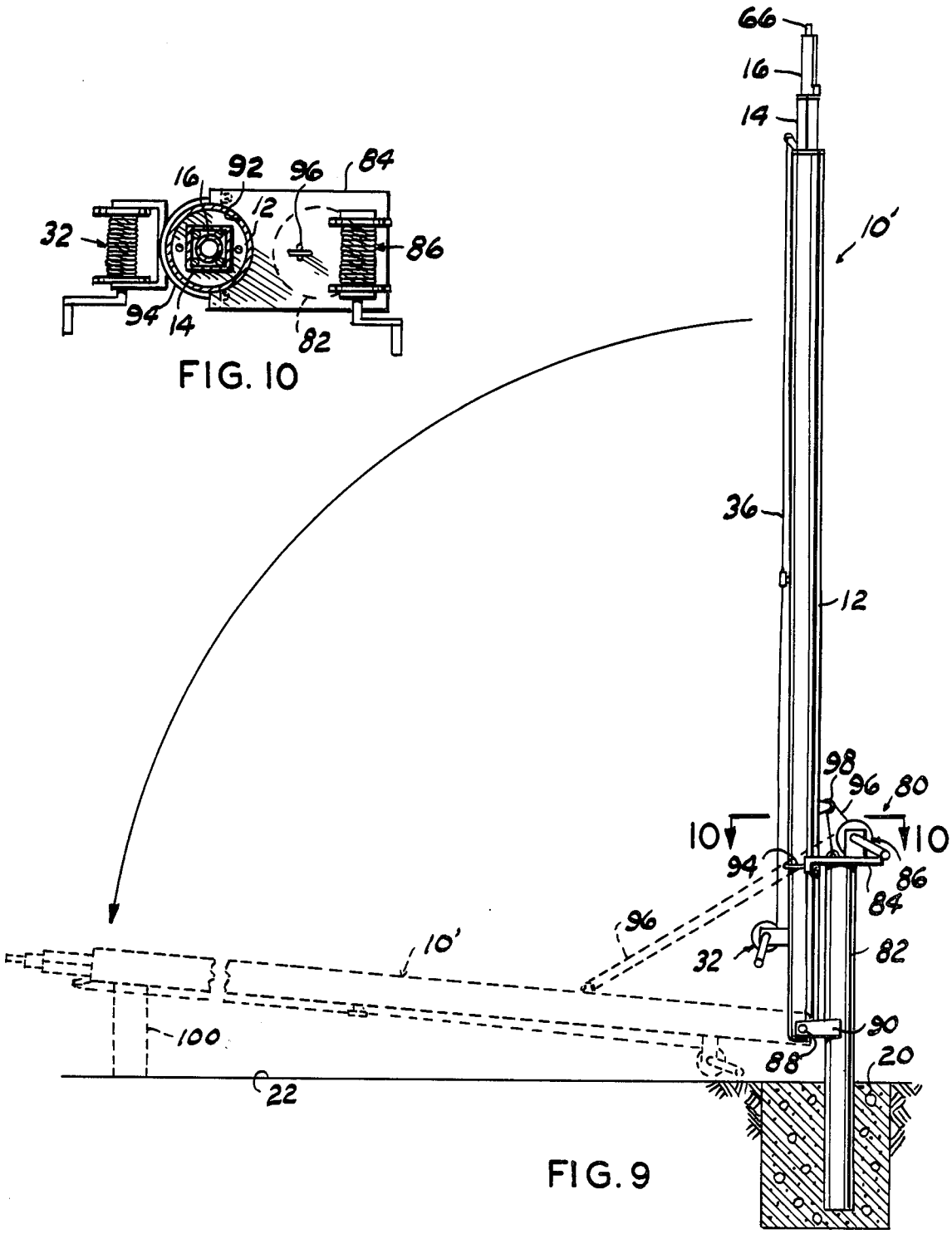
FIG. 9 is an elevational view, partially in section, illustrating, by dotted lines, the entire mast when lowered to a position adjacent the surface of the earth; and, FIG. 10 is a horizontal sectional view, partially in elevation, taken substantially along the line 10—10 of FIG. 9.

Referring to FIGS. 9 and 10, a similar tower 10', commonly known as a break-over-tower, is mounted on a standard 80 similarly anchored in concrete below the surface of the earth. The standard 80 comprises a selected length of pipe 82, or the like, having a horizontal pipe plate 84 overlying its upper end for supporting other winch means 86. The winch means 86 may be power operated, if desired. The tower 10' is substantially identical to the tower 10 having the depending end of its base 12 pivotally connected by a bolt 88 extending horizontally between a laterally projecting pair of arms 90 secured to the periphery of the pipe 82 at a selected location adjacent the surface of the earth. The pipe plate 84 is provided with a semi-circular recess 92 which nests an intermediate peripheral portion of the tower base 12 when the tower is in erected position, the erected position being maintained by a U-shaped clamp 94 secured to the pipe plate 84 and surrounding that portion of the tower base 12 opposite the recess 92. The winch line 96 is secured to the pipe plate 84 after being entrained over a small pulley 98 secured to an adjacent portion of the base 12.

When the tower 10' is to be lowered it is telescopically retracted, as described hereinabove. The clamp 94 is removed and the winch means 86 is operated to pay out its line 96 which allows the tower 10' to pivot by gravity and the restraining force of the winch line, to its dotted line position, where the normally upper end portion of the tower 10' is supported at a convenient working height by a suitable support 100.

Obviously the invention is susceptible to changes or alterations without defeating its practicability. Therefore, I do not with to be confined to the preferred embodiment shown in the drawings and described herein.

I claim:

1. An antenna supporting tower, comprising:

a plurality of vertically disposed telescoping tubes of consecutive progressively reduced transverse dimension in an upward direction and including a lowermost tube end portion rigidly secured to the earth;

individual guide means on each end portion of said tubes except the depending end of the lowermost tube and the top end of the uppermost tube for maintaining said tubes concentric and preventing angular rotation or separation of one tube with respect to a surrounded or surrounding tube;

a plurality of flexible means, one for each tube to be telescoped, connected at one end with the depending end portion of the lowermost tube and respectively extending over pulleys respectively mounted on the upper end of said tubes except the uppermost end of the upper tube and connected at its other end with the depending end of said tubes to be telescoped, respectively, for simultaneously telescopically extending or retracting said tubes; and upper and lower stabilizing means surrounding the depending end portion of said upper tube within said intermediate tube, said stabilizing means each comprising a plurality of vertically disposed right circular cylindrical rods disposed in circumferentially equally spaced vertically aligned relation, at least two of said vertically aligned rods having an axial aperture for receiving said flexible element.

2. The antenna tower according to claim 1 in which said plurality of tubes includes a lowermost tube and an uppermost tube, the uppermost tube having a transverse sectional configuration different than the lowermost tube and said flexible means comprising:

winch means mounted on the outer surface of the lowermost tube.

3. The antenna tower according to claim 1 in which said plurality of tubes comprises a lowermost tube, an intermediate tube and an uppermost tube, the intermediate tube having a square transverse sectional configuration and said flexible means comprises:

winch means mounted on the outer surface of the lowermost tube and having its cable connected with the depending end of said intermediate tube; and, a flexible element having its end opposite its connection with said lowermost tube connected with said uppermost tube.

4. The antenna tower according to claim 3 in which said guide means comprises:

a cap overlying the upper end of the lowermost tube and having a central cooperatively shaped aperture slidably receiving the intermediate tube;

a top plate overlying the upper end of said intermediate tube and having a central cooperatively shaped aperture slidably receiving the uppermost tube; and, a bottom plate surrounding the depending end portion of said intermediate tube and having a peripheral edge surface slidably received by the inner wall surface of said lowermost tube.

5. The antenna tower according to claim 1 and further including:

standard means anchored in the earth and pivotally supporting said tower for vertical pivoting movement of the tower as a unit about a horizontal axis toward and away from the surface of the earth.

6. The antenna tower according to claim 5 in which said standard means comprises:

a vertically disposed pipe;

a winch supporting plate horizontally overlying the upper end of said pipe;

a pair of laterally projecting arms horizontally secured to said pipe above the surface of the earth;

a bolt extending transversely through the depending end portion of said lowermost tube for connecting the latter with said pair of arms;

clamp means normally rigidly connecting said lowermost tube with said winch plate when the tower is vertically disposed; and, other winch means mounted on said winch plate and having its line connected with said lowermost tube intermediate its ends.

* * * * *